US005548860A

United States Patent [19]

Weltikol et al.

[11] Patent Number: 5,548,860

[45] Date of Patent: Aug. 27, 1996

[54] ULTRA-SPEED CONVERSION MEANS FOR FLOOR TREATING MACHINES

[75] Inventors: Larry E. Weltikol, Minot; Paul T. Grossman, Hazen, both of N. Dak.

[73] Assignee: Dakota Way, Hazen, N. Dak.

[21] Appl. No.: 251,722

[22] Filed: May 31, 1994

[51] Int. Cl.[6] ..... A47L 11/16

[52] U.S. Cl. ..... 15/50.1; 15/49.1; 15/98; 451/353

[58] Field of Search ..... 15/49.1, 50.1, 15/52, 98; 451/271, 350, 353, 357

[56] References Cited

U.S. PATENT DOCUMENTS

| | | | |
|---|---|---|---|
| 862,747 | 8/1907 | Miller | 451/353 |
| 1,011,954 | 12/1911 | Herr | 15/49.1 |
| 1,069,803 | 8/1913 | Nelson et al. | 451/271 |
| 1,517,980 | 12/1924 | Green et al. | 15/50.1 |
| 1,626,742 | 5/1927 | Lockwood | 15/98 |
| 1,635,474 | 7/1927 | Gillis | 15/49.1 |
| 1,661,510 | 3/1928 | Sproston | 15/98 |
| 1,748,548 | 2/1930 | Gillis | 15/98 |
| 1,768,137 | 6/1930 | Newcomer | 15/49.1 |
| 1,773,993 | 8/1930 | Gillis | 15/50.1 |
| 2,007,073 | 7/1935 | Clarke | 451/353 |
| 2,142,933 | 1/1939 | Bickford | 15/50.1 |
| 2,624,896 | 1/1953 | Atkin | 15/49.1 |
| 2,626,412 | 1/1953 | Petersen | 15/50.1 |
| 2,950,494 | 8/1960 | Dickson | 15/50.1 |
| 5,170,595 | 12/1992 | Wiand | 451/353 |

FOREIGN PATENT DOCUMENTS

| | | | |
|---|---|---|---|
| 1353242 | 1/1964 | France | 15/50.1 |
| 158194 | 1/1933 | Switzerland | 15/49.1 |
| 383147 | 11/1932 | United Kingdom | 15/49.1 |
| 734834 | 8/1955 | United Kingdom | 15/50.1 |

*Primary Examiner*—Mark Spisich
*Attorney, Agent, or Firm*—David A. Lingbeck

[57] ABSTRACT

This invention relates to a ultra-speed conversion apparatus for floor treating machines which comprises a wheeled frame, an impeller member attached to the floor treating drive of the floor treating machines for rotation therewith, a plurality of floor treating element holders journaled through the impeller member and circumferentially spaced near the perimeter thereof. The floor treating element holders rotatably move in a track on the frame as the impeller member rotates. Ultra-speed floor treating elements are fastenable to the floor treating element holders which are capable of rotating in excess of 6600 rpm; whereas, the impeller member rotates at approximately 175 rpm. Because of such ultra speeds, the ultra-speed floor treating elements can burnish, strip, sand paper, wax, clean the floors including carpets and rugs more conveniently, faster, and more effectively than slower speed floor treating elements on floor treating machines not using this invention.

4 Claims, 8 Drawing Sheets

ULTRA-SPEED CONVERSION MEANS FOR FLOOR TREATING MACHINES

BACKGROUND OF THE INVENTION

This invention relates to an ultra-speed conversion means for floor treating machines to substantially increase the effectiveness of buffers, in particular, as to burnishing, stripping, scrubbing, sanding, and waxing floors including carpets and rugs as such.

Floor treating machines such as carpet cleaners, buffers, floor stripping machines, floor waxing machines, and floor sanding machines as such are known in art. The prior art includes machines which conventionally have a direct drive mechanism for actuating the floor treating elements thereunder. The drive shaft from the motor is connected directly to the rotatable element support member. The drive shaft in such machines typically rotate at from 175 rpm to 300 rpm which is also the speed of the rotatable element support member and floor treating member since the drive shaft is connected directly to the element support member. None of the prior art describes a drive mechanism which increases the speed of the floor treating element or elements on the floor treating machine in excess of 6600 rpm which is the speed the ultra-speed conversion means of the present invention is capable of achieving and which produces exceptional results on the floors.

One known prior art are POWER DEVICES HAVING REVERSIBLE DRIVE, U.S. Pat. No. 3,451,495, a base for contacting a surface to be treated, a wheel rotatably mounted on the base, a strain wave gearing assembly having a plurality of gears wherein one of the gears rotates in an opposite direction from the others effectively reversible drive in the devices.

Another known prior art is a NOISE REDUCTION OF GEAR TRAIN, U.S. Pat. No. 3,469,470, comprising a gear train having a steel pinion gear meshed with a nylon gear wheel which is meshed with a pair of "Rexin" gear wheels which aluminum inserts for reducing the noise in the gear train.

Another known prior art is a HIGH-SPEED POLISHING MACHINE, U.S. Pat. No. 4,115,890, comprising a platform, wheels at a rear portion of the platform, a housing at a forward portion of the platform, a rotatable pad driver supported by the housing, a motor mounted on an intermediate portion of the platform to provide a straight drive to the pad driver, and handles to use the machine.

Another known prior art is a HIGH-SPEED FLOOR TREATING MACHINE, U.S. Pat. No. 4,122,576, comprising a frame, handle means attached to the frame, a support for the frame, an electric motor mounted on the frame, a floor treating means comprising an annular shaped brush, which is rotated with a belt and pulley carried by the drive shaft of the motor.

Another known prior art is a HIGH SPEED FLOOR POLISHER, U.S. Pat. No. 4,358,868, comprising a frame, wheels, suspension means for suspending the frame, and drive means directly connected to a motor, for rotating a floor treatment element.

Another known prior art is a FLOOR CLEANING AND POLISHING MACHINE, U.S Pat. No. 4,393,534, comprising a disk, support for the disk, means for imparting rotational motion to the support, and a variant speed element which geared from the power source.

Another known prior art is a MACHINE FOR FLOOR MAINTENANCE, U.S. Pat. No. 4,590,635, comprising a body, an annular stator supported by the body, a shaft disposed in the stator, and an annular rotor journaled for rotation about the shaft.

Another known prior art is a FLOOR TREATING MACHINE, U.S. Pat. No. 4,633,541, comprising a frame, a brush housing connected to the frame, a brush for treating the floor, and means for positioning the brush with respect to the floor.

Another known prior art is a FLOOR POLISHER, U.S. Pat. No. 4,910,824, comprising a vertically moving mechanism adapted to move said pad in a vertical direction, a ground pressure adjusting mechanism for maintaining a ground pressure on the pad, and a floor protecting mechanism to control the vertically moving mechanism.

Another known prior art is an ADJUSTABLE SUSPENSION FOR HIGH SPEED PAD DRIVER, U.S. Pat. No. 5,127,124, comprising a housing, wheels, a drive motor, and pulley arrangement for rotating a circular pad attached to a mounting plate, and an apparatus for positioning the mounting plate over a range of heights above the floor to accommodate a range of pad thicknesses.

None of the prior art described above anticipates, suggests, or describes a ultra-speed conversion means which will dramatically increase the speed of the floor treating elements relative to the speed of the drive shaft of the motor to substantially enhance the treatment of the floors as such. There is a need for a ultra-speed conversion means for floor treating machines which substantially increases the speed and performances of such machines.

SUMMARY OF THE INVENTION

This invention relates to an ultra-speed conversion means for floor treating machines comprising a height adjustable and moveable frame having an annular stator means at a forward portion thereof and having a pair of wheels with stems lockingly threaded through a rearward portion opposite the stator means and further having a third wheel also with a stem lockingly threaded through the forward portion of the frame. An impeller member is fixedly attachable to the floor treating drive means of floor treating machines for rotation therewith and is rotatably received in the stator means. A plurality of floor treating element holders are circumferentially spaced apart near the perimeter of the impeller member and are rotatably journaled through the impeller member. The floor treating element holders are capable of rotating in excess of 6600 rpm; whereas, the impeller member rotates at approximately 175 rpm. Brushes, sand papers, and other floor treating elements are detachably attached to the floor treating element holders which also rotate in excess of 6600 rpm. The higher rate of rotation of the ultra-speed floor treating elements the more effective job in burnishing, sand papering, waxing, cleaning, and stripping floors including carpets and rugs.

One objective of the present invention is to provide an ultra-speed conversion means for floor treating machines which do a much more effective and better job at treating floors than does the conventional prior art.

Another objective of the present invention is to provide an ultra-speed conversion means for floor treating machines which greatly accelerates floor treating elements in excess of 6600 rpm as compared to the conventional floor treating elements which rotate at only 175 rpm. Floor treating elements rotating at ultra-high speeds do a much better job at treating floors than does the prior art.

Also, another objective of the present invention is to provide an ultra-speed conversion means for floor treating machines which allows the floor treating machines to be conveniently and effectively operated by only one person rather than two or more persons as required for the prior art.

Further, another objective of the present invention is to provide an ultra-speed conversion means for floor treating machines which effectively prevents floor treating solution from moving beyond the perimeter of the stator means and effectively confines all floor treating solution used in the floor treating machines within the perimeter of the stator means.

Yet, another objective of the present invention is to provide an ultra-speed conversion means for floor treating machines which essentially functions as a vacuum in that all the floor treating solution on the floors is used instead of being left on the floors after being treated by the floor treating machines.

Further objects and advantages of the present invention will become apparent as the description of the present invention proceeds and when taken in conjunction with the accompanying drawings wherein:

DETAILED DESCRIPTION OF THE DRAWINGS

Figure 1:
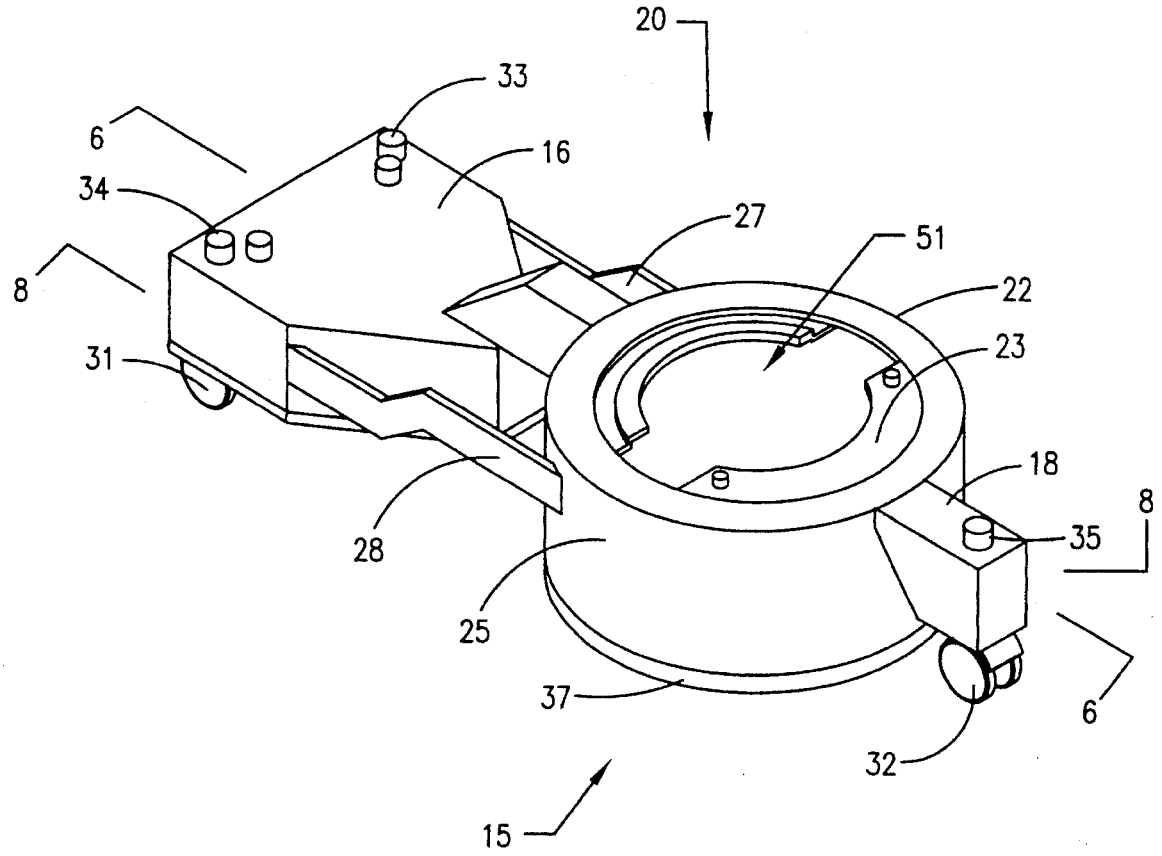
FIG. 1 is a top perspective view of the base member of the ultra-speed conversion means for floor treating machines.
Figure 2:
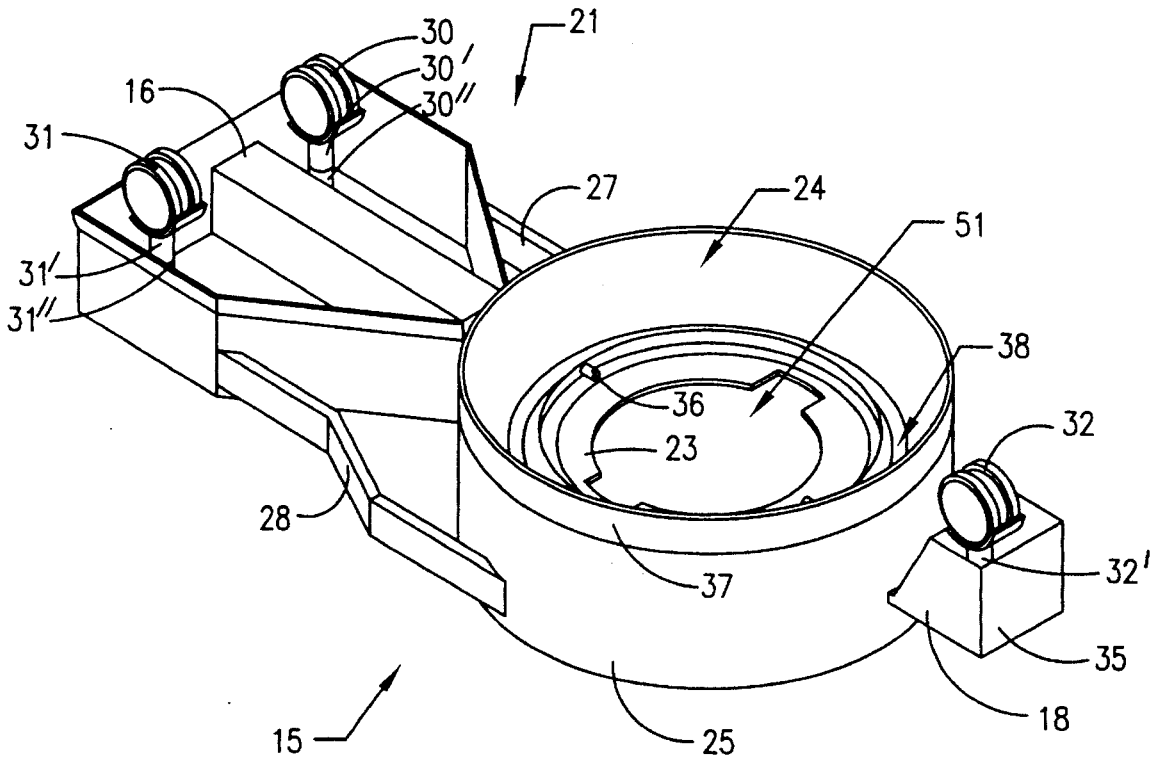
FIG. 2 is a bottom perspective view of the base member of the ultra-speed conversion means for floor treating machines.
Figure 3:
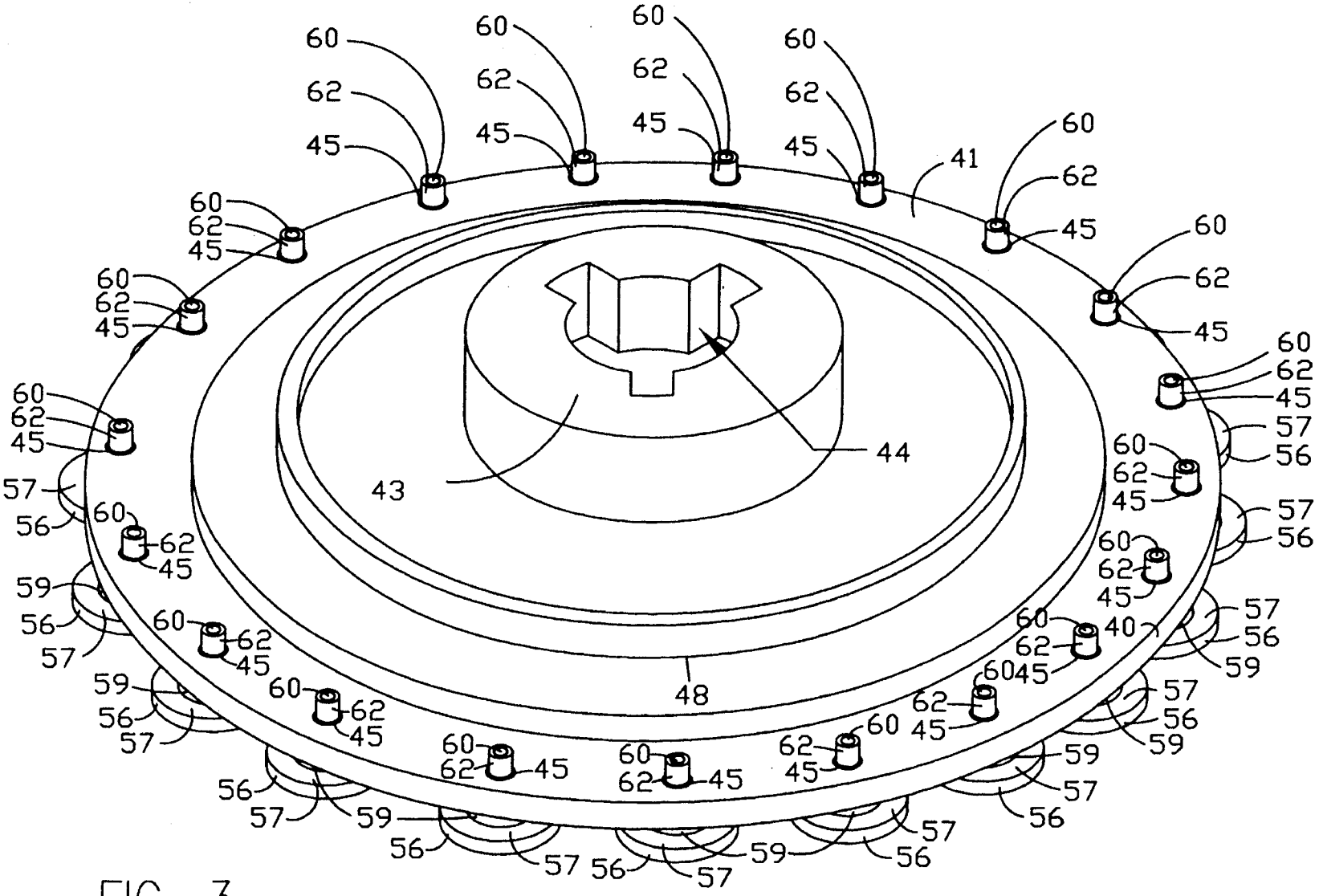
FIG. 3 is a top perspective view of the impeller member of the ultra-speed conversion means for floor treating machines.
Figure 4:
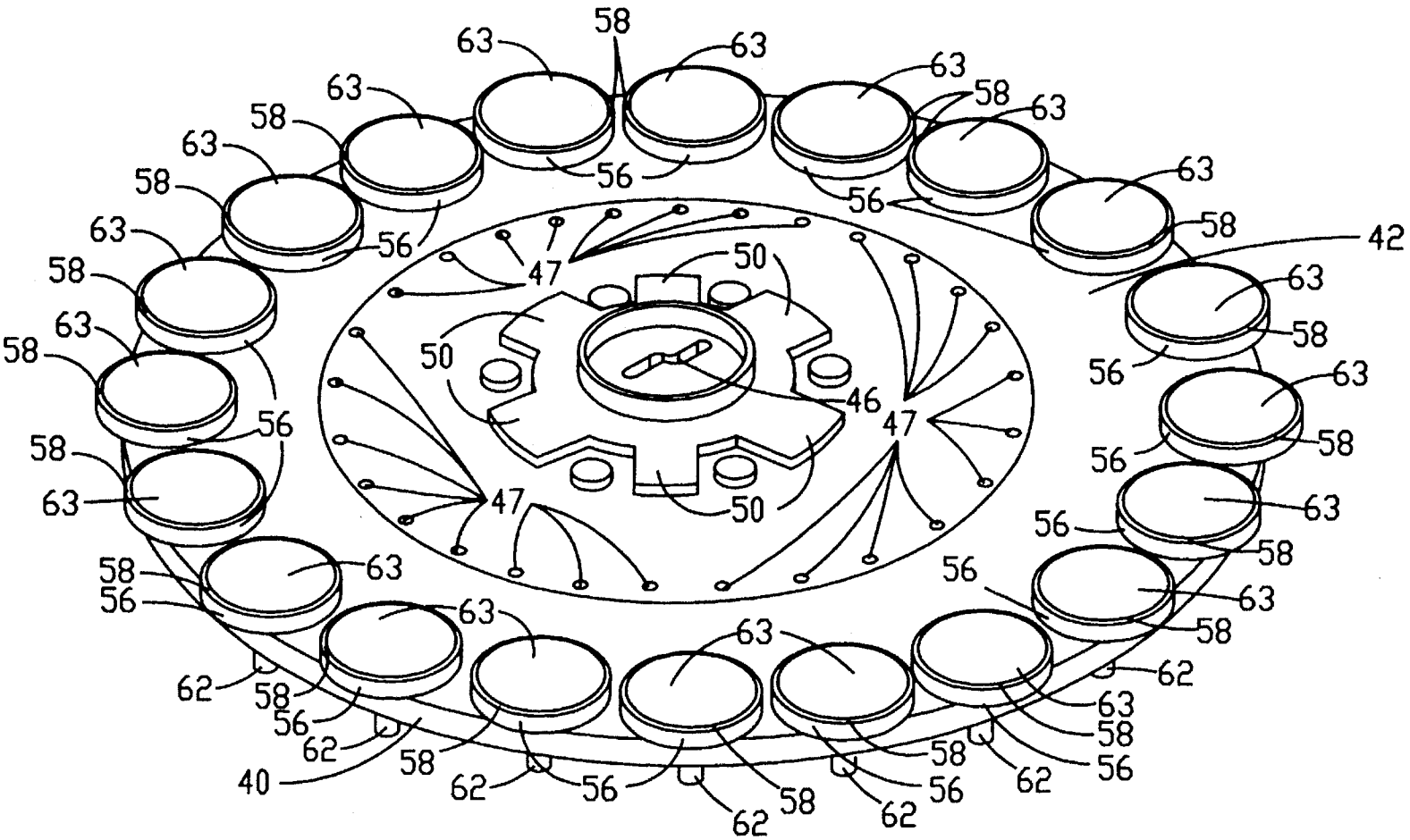
FIG. 4 is a bottom perspective view of the impeller member of the ultra-speed conversion means for floor treating machines.
Figure 5:
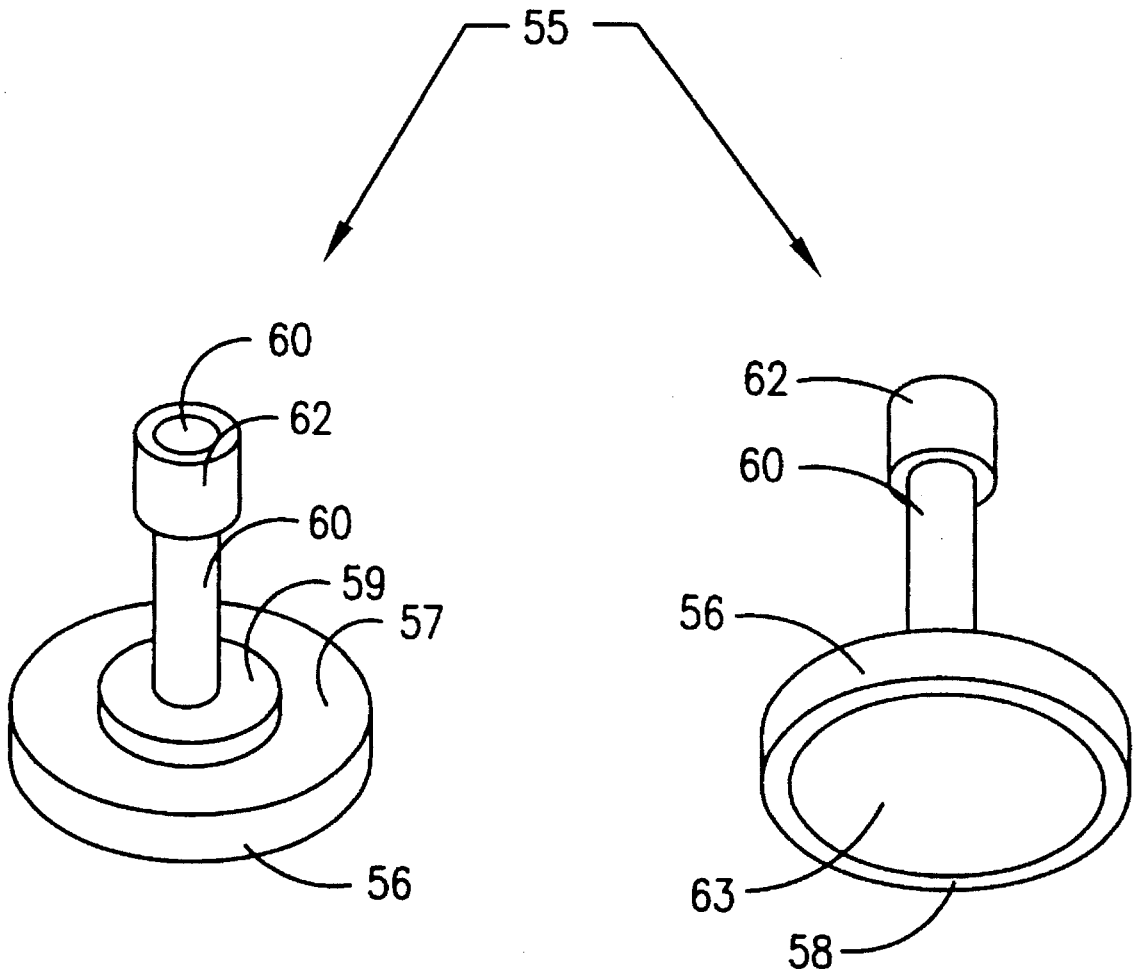
FIG. 5 is a perspective view of the floor treating element holder of the ultra-speed conversion means with an ultra-speed floor treating element removed therefrom.
Figure 6:
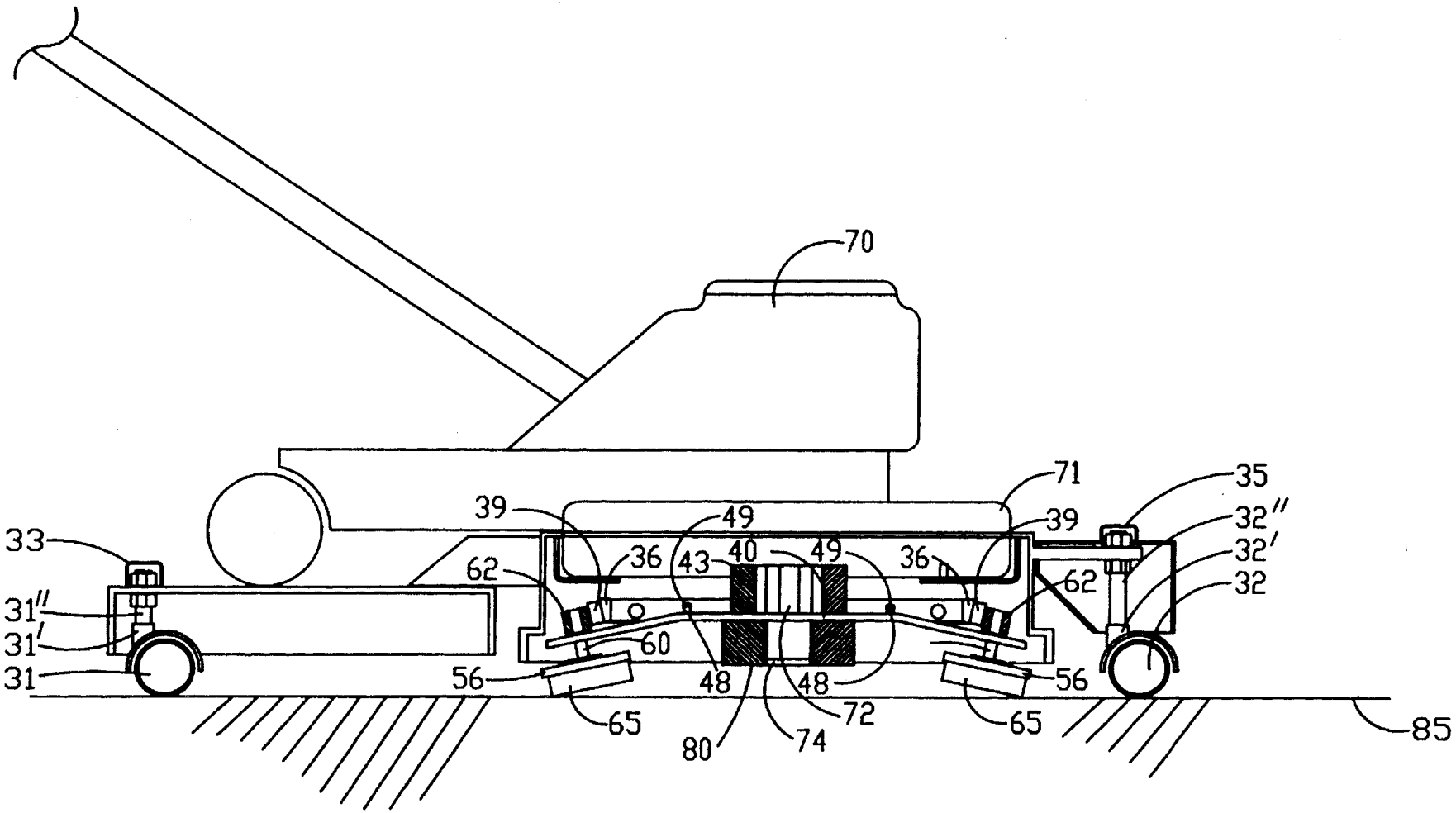
FIG. 6 is a cross-sectional side view of the ultra-speed conversion means on a floor treating machine taken along line 6—6 of FIG. 1.
Figure 7:
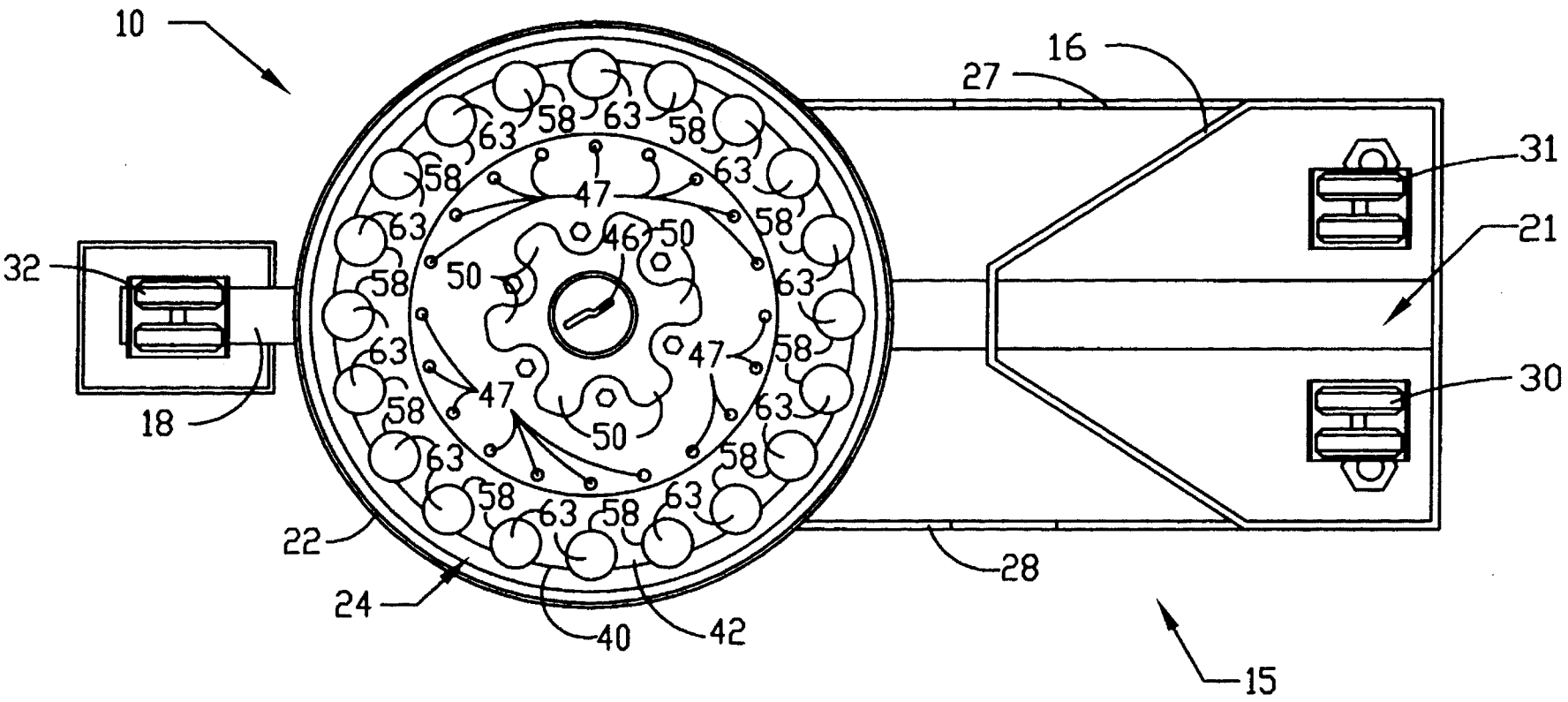
FIG. 7 is a bottom view of the ultra-speed conversion means on a floor treating machine.
Figure 8:
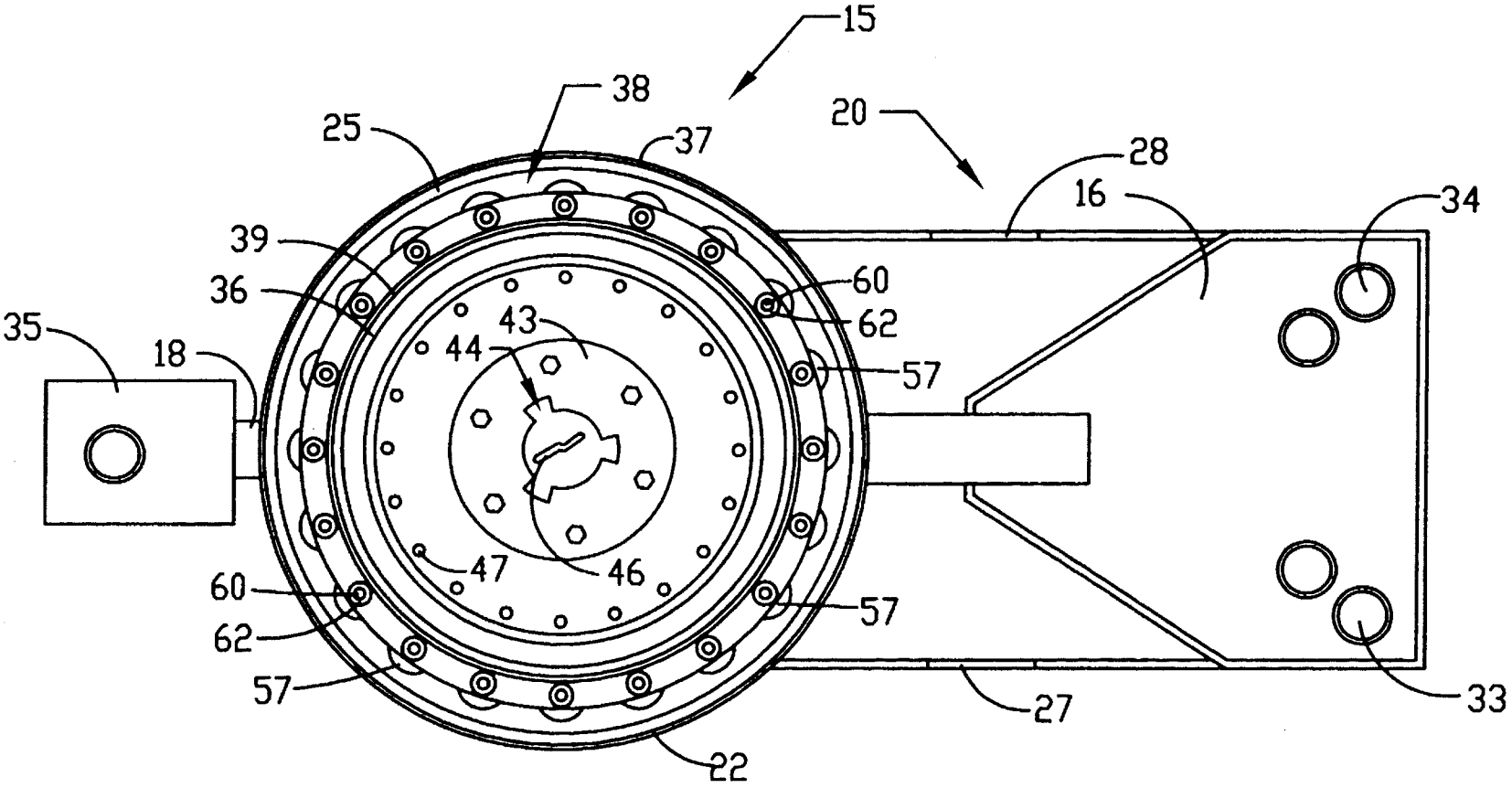
FIG. 8 is a cross-sectional top view of the ultra-speed conversion means on a floor treating machine taken along line 8—8 of FIG. 1.

Referring to the drawings in FIGS. 1 through 8, in particular, the ultra-speed conversion means 10 for floor treating machines 70 comprises a height adjustable and moveable frame 15 having a rearward portion 16, a forward portion 18, a bottom 21 and a top 20 and being disposed generally parallel to the floor 85 to support a floor treating machine 70. The frame 15 further comprises a pair of roller members having roller bodies 30 & 31 journaled to support brackets 30' & 31' and having stems 30" & 31" rotatably disposed in the support brackets 30' & 31' and lockingly threaded through the bottom 21 of the frame 15 in the rearward portion 16 thereof and also comprises a third roller member also having a roller body 32 journaled to a support bracket 32' and having a stem 32" rotatably disposed in the support bracket 32' and lockingly threaded through the bottom 21 of the frame 15 in the forward portion 18 thereof to support and move the frame 15 upon the floor 85. The roller members have fasteners (not shown) such as nuts or the like which are threaded on the stems and which engage the bottom 21 and top 20 of the frame 15 and vertically set the frame 15 at the desired heights as selected by the users of the floor machines. Protective covers 33, 34, & 35 removeably cover the stems 30", 31", & 32" of the roller members to protect the users during use of the floor treating machines 70. The frame 15 further has a stator means 22 forming much of the forward portion 18 thereof and having a top 23, an open bottom 24, and an annular side wall 25 being generally tapered outward from the top 23 to the open bottom 24. The top 23 of the stator means 22 has an opening 51 therethrough, which is shaped and dimensioned to receive the rotatable floor treating drive means 72 of the floor treating machines 70 and is disposed generally parallel to the floor 85. A rubber squeegee member 37 is removeably attached with a screw clamp (not shown) or the like about the annular side wall 25 of the stator means 22 at the bottom 24 thereof for confining floor treating solutions within the perimeter of the stator means 22 during operation of the floor treating machine 70. An annular flange means 36 integrally extends downward from the interior of the top 23 inside the stator means 22 and is spaced apart from the annular side wall 25 thus forming an annular track 38 therebetween. The annular flange means 36 has an abrasive or corrugated or ratchet outer surface 39 facing the interior of the annular side wall 25. A pair of braces 27 & 28 have ends fixedly attached or welded to the exterior of the side wall of the stator means 22 and have opposite ends fixedly attached or welded to the rearward portion 16 of the frame 15 to provide strength and support to the frame 15.

As shown in FIGS. 3, 4, 7, and 8, an impeller member 40 being generally disk-shaped and having a generally concave-convex profile and having a generally convex top side 41 and a generally concave bottom side 42 and further having a generally cylindrical clutch member 43 integrally extending upward from a central portion of the top side 41. The clutch member 43 has a top end which has an aperture 44 extending therethrough along the longitudinal axis of the cylindrical clutch member 43, the aperture 44 being shaped and dimensioned to receive the drive shaft of the floor treating drive means 72 of the floor treating machine 70. Three conventional longitudinal slotted portions extend in the wall forming the aperture 44 to facilitate the mounting of the clutch member 43 onto the drive shaft of the floor treating machine 70. Once the drive shaft is extended through the aperture 44 in the clutch member 43, the user mounts the impeller member 40 to the drive shaft by turning the impeller member so that the slotted portions in the aperture 44 are offset from matching extensions on the drive shaft. A narrow slot 46 extends through a central portion of the bottom side 42 generally coaxial to the aperture 44 through the clutch member 43 to allow the user to extend a conventional tool or wrench through the slot to turn or twist lock or detachably fasten the clutch member 43 of the impeller member 40 to the floor treating drive means 72 so that the impeller member 40 rotates with the floor treating drive means 72. A plurality of projecting fastener means 50 integrally extend from the bottom side 42 of the impeller member 40 for engagement to a floor treating member 80 such as a brush or pad to securely hold and support the floor treating member 80 which is centered upon the bottom side 42 of the impeller member 40 which further has a plurality of holes 45 extending through and circumferentially and equally spaced about the impeller member 40 near the perimeter thereof. A plurality of conventional bearing means (not shown) are securely engaged in the holes 45. An annular groove 48 extends in the top side 41 of the impeller member 40 between the clutch member 43 and the perimeter thereof. An annular rubber seal 49 is received in the groove 48 and extends upward therefrom to engage a portion of the bottom 71 of a floor treating machine 70 to substantially prevent dirt, dust, and other particles from entering and damaging the motor means of the floor treating machine 70. A plurality of perforations 47 extend through the impeller member 40 to allow solution to flow from the floor treating machine 70 to the floor 85 for the treatment thereof.

As shown in FIGS. 5–8, a plurality of floor treating element holders 55 each comprising a disk-shaped member 56 having a bottom side 58 and a top side 57, and comprising a boss 59 centrally disposed in the top side 57 of the disk-shaped member 56, and comprising a stem 60 having a first end securely disposed in the boss 59, said stem 60 extending outward from the top side 57 of the disk-shaped member 56, and further comprising a flange member 62 having a ratchet-like or corrugated outer surface and being fixedly attached or engaged about the stem 60 near a second end thereof. The stems 60 of the floor treating element holders 55 are rotatably journaled in the bearing means (not shown) which are engaged in the plurality of holes 45 in the impeller member 40. The flange member 62 is exposed to the top side 41 of the impeller member 40, and the disk-shaped member 56 is exposed to the bottom side 42 of the impeller member 40. The flange member 62 is dimensioned to be rotatably received in the annular track 38 of the frame 15 and to be engaged to outer surface 39 of the annular flange means 36 which rotates the floor treating element holders during operation of the floor treating machines 70. The bottom sides 58 of the disk-shaped members 56 have fastener members 63 such as "VELCRO" fixedly attached thereto with adhesive or the like. Ultra-speed floor treating elements 65 such as brushes, stripper pads, sand papers, and the like are fastenable to the bottom sides 58 of the disk-shaped members 56 to the fastener members 63, for treating floors 85.

To use the ultra-speed conversion means 10 for floor treating machines 70, the user should mount a floor treating machine 70 upon the top 23 of the stator means 22 of the frame 15 with the floor treating drive means 72 extending through the opening 51 in the top 23. The user may lay the floor treating machine 70 over on its side with the frame 15 lying on its edge to lockingly attach the impeller member 40 about the floor treating drive means 72 which is connected to the motor means of the floor treating machine 70. The user should position the impeller member 40 through the bottom 24 of the stator means with the top side 41 of the impeller member 40 facing the floor treating drive means 72 and should extend the flanged ends 62 on the stems 60 of the floor treating element holders 55 in the track 38 formed on the interior of the top 23 of the stator means and should slide the impeller member 40 toward the drive shaft mechanism 72 so that the clutch member 43 receives the bottom 74 of the floor treating drive means 72. The user should then extend the conventional tool or wrench through the slot in the bottom of the impeller member 40 to twist lock and detachably fasten the impeller member 40 to the floor treating drive means 72 for rotation therewith. The user can now position the floor treating machine 70 upright with the frame 15 generally horizontally disposed parallel to the floor. The user can adjust the height of the frame 15 by threadingly adjusting the fasteners (not shown) on the stems 30". 30", & 32" of the roller members 30, 31, & 32 to raise or lower the roller members 30, 31, & 32 relative to the frame 15.

To actuate the ultra-speed conversion means, the user can activate or turn on the motor of the floor treating machine 70, which actuates the floor treating drive means 72 which rotates the impeller member 40 at the same rotational speed as the floor treating drive means 72 which is approximately 175 rpm. As the impeller member 40 rotates with the floor treating drive means 72, the plurality of floor treating element holders 55 move with the impeller member 40 about a circle about the axis of the impeller member 40 in the track 38 and the flange members 62 on the stems 60 of the floor treating element holders 55 engage the annular flange means 36 as the stems 60 move through the track 38, the annular flange means thus effecting rotation of the floor treating element holders 55 about their axes. The flange members 62 extending about the stems 60 of the floor treating element holders 55 have circumferences in excess of 50 times smaller than the circumference of the impeller member 40. Because of the these differences in the circumferences of the floor treating element holders 55 and the impeller member 40, the floor treating element holders 55 will rotate much faster than the impeller member 40 and are capable of achieving speeds in excess of 50 times faster than that of the impeller member 40 and are capable of rotating in excess of 6600 rpm as compared to 175 rpm by the impeller member 40. Ultra-speed floor treating elements 65 such as brushes and pads are detachably attached to the bottom sides 58 of the floor treating element holders 55 and are engageable to the floors 85 including carpets and rugs for the treatment thereof such as burnishing, waxing, stripping, sanding, or cleaning. The ultra-speed floor treating elements 65 rotate at the same speed as the floor treating element holders 55.

Various changes and departures may be made without departing from the spirit and scope thereof. Accordingly, it is not intended that the invention be limited to that specifically described in the drawings but only as set forth in the claims.

What is claimed is:

1. Ultra-speed conversion means for a floor treating machine comprising:

a height adjustable and moveable frame supported on wheels and having a stator means, for supporting a floor treating machine;

an impeller member received in said stator means and securely fastenable to a rotatable floor treating drive means of said floor treating machine for rotation therewith, said impeller member having a top side and a bottom side and further having a clutch member extending upward from said top side thereof, said clutch member having an aperture therein for receiving said floor treating drive means for rotation therewith;

a plurality of floor treating element holders rotatably journaled through said impeller member and rotatably engageable with said stator means, for ultra-speed rotation relative to said impeller member; and a plurality of floor treating elements each on a respective one of said floor treating element holders for engageably treating floors.

2. Ultra-speed conversion means for use with a floor treating machine as described in claim 1, wherein said clutch member is dimensioned to mountably attach to said floor treating drive means so that said impeller member can rotate with said floor treating drive means.

3. Ultra-speed conversion means for use with a floor treating machine as described in claim 1, wherein said impeller member has fastener means on said bottom side thereof for securely holding a floor engageable floor treating member thereto.

4. Ultra-speed conversion means for a floor treating machine as described in claim 1, wherein said impeller member has a plurality of perforations extending therethrough and thereabout, for allowing floor treating solution from said floor treating machine to be applied to a floor.

* * * * *